United States Patent [19]

Hare

[11] Patent Number: 4,539,170

[45] Date of Patent: Sep. 3, 1985

[54] PROCESS FOR STEAM-CONDITIONING SPIN-ORIENTED POLYAMIDE FILAMENTS

[75] Inventor: James W. Hare, Martinsville, Va.

[73] Assignee: E. I. Du Pont de Nemours and Company, Wilmington, Del.

[21] Appl. No.: 535,689

[22] Filed: Sep. 26, 1983

[51] Int. Cl.[3] ..... D01D 5/12

[52] U.S. Cl. ..... 264/176 F; 264/210.1; 264/289.3; 425/66

[58] Field of Search ..... 264/176 F, 210.3, 210.8, 264/210.1, 289.3; 425/66

[56] References Cited

U.S. PATENT DOCUMENTS 3,361,859 1/1968 Cenzato ..... 264/176 F
3,448,186 6/1969 Nicita et al. ..... 264/176 F
3,752,457 8/1973 Parmeggiani et al. ..... 264/176 F
3,994,121 11/1976 Adams .
4,069,657 1/1978 Bascom et al. ..... 264/210.8
4,181,697 1/1980 Koschinek et al. .

FOREIGN PATENT DOCUMENTS 2741193 3/1979 Fed. Rep. of Germany ... 264/210.8

*Primary Examiner*—James Lowe

[57] ABSTRACT

An improved high-speed spinning process for making steam-conditioned partially-oriented polyamide draw-texturing feed yarns involves controlling the wall temperature of the lower portion of a steam conditioning tube independently of the steam flow and temperature in the upper tube.

6 Claims, 4 Drawing Figures

PROCESS FOR STEAM-CONDITIONING SPIN-ORIENTED POLYAMIDE FILAMENTS

TECHNICAL FIELD

This invention relates to an improved process for conditioning partially-oriented polyamide filaments with steam while being spun at high speed. More particularly, it relates to such a process which provides improved control of filament dyeability within predetermined limits.

BACKGROUND

U.S. Pat. No. 3,994,121 (Adams) discloses a process for making filaments of poly(hexamethylene adipamide) having a birefringence of at least 0.040 by withdrawing the filaments from the spinneret at a high spinning speed and conditioning the freshly cooled filaments with steam to increase their thermal shrinkage and to improve their package-forming characteristics prior to being wound up. The acid dyeability of filaments spun in this manner can be quite sensitive to the steaming conditions. Consequently, when steaming conditions change, such as in order to provide a desired draw-tension, boil-off shrinkage, or improved package formation, the acid dyeability of the filaments also can change resulting in a need to segregate products where dye mergeability is critical. In general, as the degree of steaming is increased, the acid dyeability of the filaments increases.

U.S. Pat. No. 4,181,697 (Koschinek et al.) teaches a similar high-speed spinning process wherein the filaments are heat-treated under specified conditions in a steamless spinning duct prior to being wound. Such a process provides for no control of acid-dyeability independently of the heating conditions required for other yarn properties such as package stability.

Partially oriented polyamide yarns made by either of the above processes are especially useful as draw-texturing feed yarns in the trade. Improvements in draw-texturing apparatuses are continually being made to permit them to operate at higher speeds which provide economies in overhead and operating expenses. Consequently, there is an accompanying demand for improved yarns which operate satisfactorily at these higher processing speeds in order to take advantage of the apparatus improvements. Important in this regard are uniformity improvements in yarn drawing tension and package formation, especially with regard to larger packages, while maintaining a uniform dyeability.

Consequently, an object of this invention is a process which facilitates the uniform preparation of partially-oriented draw-texturing polyamide feed yarns within predetermined limits of yarn properties such as draw-tension and packageability independently of acid dyeability.

DESCRIPTION OF THE INVENTION

Figure 1:
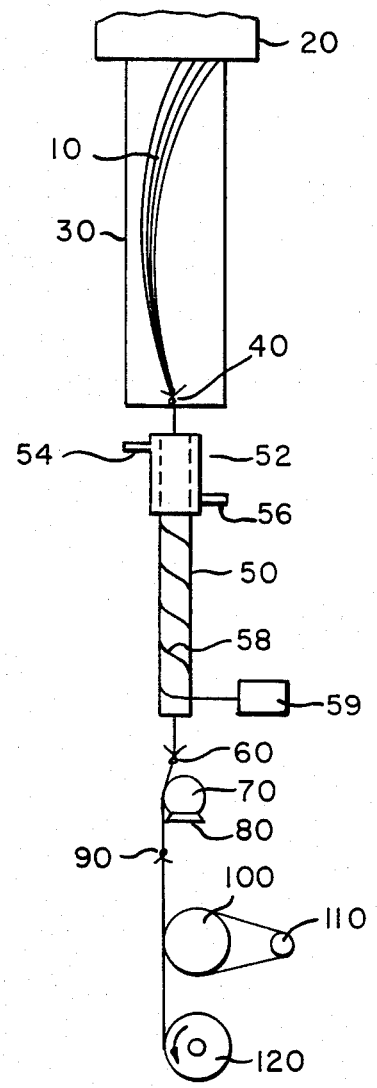
FIG. 1 is a diagrammatic representation of a process of this invention for making a yarn.

This invention provides an improved high-speed spinning process for making partially oriented polyamide draw-texturing feed yarns within predetermined standards including the steps of extruding molten filaments of a synthetic fiber-forming polyamide from a spinneret assembly, cooling the molten filaments to a non-tacky state in a quench chimney, conditioning the cooled filaments with steam by passage through a substantially vertical conditioning tube having heated upper and lower inner wall portions, introducing steam into the tube within its heated upper wall portion and winding up the conditioned filaments under tension into a yarn package at a speed of from 3000 to 4000 ypm (2743 to 3658 mpm) wherein the improvement comprises regulating the temperature of the lower heated wall portion independently of the upper steam-heated portion to maintain yarn properties that vary with changes in the lower heated wall portion, within predetermined limits while maintaining steam flow in the tube substantially constant whereby the acid dyeability of the yarn remains substantially unchanged.

The invention is particularly effective with respect to yarns of aliphatic polycarbonamides, commonly called nylon, such as poly(epsilon-caproamide) and poly(hexamethylene adipamide) and especially the latter because of its importance to the textured yarn hosiery industry.

The upper wall portion of the conditioner can be heated conveniently, as is known, with a superatmospheric steam supply which surrounds and heats the upper wall portion and provides a source of steam into the tube by means of an appropriately sized orifice or orifices leading into the tube through a plug in its heated wall. The lower wall may be heated most conveniently by an electrical heating element or elements with a conventional temperature control means.

For the preparation of conventional low denier hosiery yarns suitable rates of steam flow in the conditioning tube have been found within the range of from 0.25 to 1.25 lbs. per hour (113.4–567 gm/hr.) with lower wall temperatures appropriately selected within the range of 60° to 115° C.

A preferred conditioning tube is comprised of an upper wall portion conventionally heated by a superatmospheric steam jacket about 20 inches (0.508 m) long and a total tube length of about 6.5 feet (1.98 m), with the length below the steam jacket being wrapped with an electrical heating element. Steam can be introduced into the tube by means of an orifice in a replaceable plug in the tube wall between the steam jacket and the tube interior with steam flow being regulated by the size of the orifice. The orifice suitably can have a diameter of from about 0.028 to 0.040 inch ($7.1\times10^{-4}$ to $1.02\times10^{-3}$ m) with a steam supply maintained at a pressure of about 7.5 psig (51.7 kPa gauge).

The process of this invention is especially useful for regulating yarn draw-tension and/or yarn package bulge within predetermined limits independently of the MBB acid dyeability of the yarn. The need for such control can come about through normal process changes which can accompany a change in spinning speed, an increase in yarn package size, and so forth for higher productivity. With this invention such changes can be accommodated while maintaining yarn dyeability within acceptable limits and thereby maintaining its dye mergeability with other yarns.

TEST METHODS

Draw tension is a function of the level of molecular orientation and crystallinity which relate to physical properties of a yarn. These physical properties relate not only to how the yarn will process during later operations, such as in texturing, but also to properties of the textured yarn and characteristics of fabrics made therefrom. Draw tension is measured using the apparatus described in U.S. Pat. No. 4,295,360. The yarn is drawn 1.33×; feed roll surface velocity is 200 ypm (182.88 mpm) and heater temperature is 185° C.

Package bulge is a measure of non-uniformity of a package of yarn. Package bulge is the extent that yarn bulges or protrudes from the package shoulder. The yarn package consists of the yarn wound onto a 2.5" ($6.35\times10^{-2}$ m) cylindrical rigid paper core. The package surface forms essentially a right cylinder having a diameter of 5.25 inches (0.13335 m). A straightedge is positioned along the package shoulder normal to the package axis of rotation. The axial distance in inches between the point the yarn touches the straightedge (the tip of the bulge) and the normal package shoulder (unbulged yarn) is the "Package Bulge". A package bulge of up to 1/16 inch ($1.5875\times10^{-3}$ m) is acceptable while a bulge of greater value than 4/16 inch ($6.35\times10^{-3}$ m) is intolerable causing such handling and processing difficulties that the package has to be put to waste.

For MBB dye testing in the following example yarn samples are prepared by loosely winding 3.00 gram skeins. Thirty-six of these skeins, consisting of 6 control samples and 30 test samples, are scoured by immersing them in a vessel containing 21 liters of room temperature scouring solution comprised of 160 ml ammonium hydroxide, 100 ml 10% Merpol HCS, (a liquid, nonionic detergent from E. I. du Pont de Nemours and Co.), with the remainder of the solution being demineralized water. This bath has a pH of 10.4. The bath containing the yarn samples is heated to 95° C. at the rate of 3° per minute. The samples are removed and the bath discarded when the temperature reaches 95° C.

The yarns are then dyed by placing the 36 samples in 21 liters of an aqueous dye solution comprised of 200 ml of a standard buffer solution at 3.8 pH, 100 ml of 10% Merpol HCS (a liquid, nonionic detergent from E. I. du Pont de Nemours and Co.), 5 ml Depuma (a silicone defoaming agent), and 500 ml of 0.18% Anthraquinone Milling Blue BL (abbreviated MBB) (C.I. Acid Blue 122). The final bath pH is 4.4. The solution temperature is increased at 3°/min from room temperature to 75° C., and held at that temperature for 30 minutes. The dyed samples are rinsed, dried, and measured for dye depth by reflecting colorimeter.

The dye values are determined by computing K/S values from reflectance readings. The equations are:

$$MBB\ \text{dyeability} = \frac{K/S\ \text{sample}}{K/S\ \text{control}} \times 180 \text{ and } K/S = \frac{(1-R)'}{2R}$$

when R = the reflectance value. The 180 value is used to adjust and normalize the control sample dyeability to a known base.

EXAMPLE

This example tests yarn responses to changes in steam flow and in lower wall temperatures of a conditioning process for partially-oriented draw-texturing feed yarns of poly(hexamethylene adipamide) made according to this invention.

The yarns are spun using the process as represented by FIG. 1. In reference to FIG. 1, filaments 10 are extruded from spinneret assembly 20 into quench chimney 30 and are cross-flow quenched by room temperature air (flowing from right to left as represented). After cooling to a non-tacky state, the filaments are converged into a yarn by guide 40, passed through steam-conditioner tube 50, through guide 60 and over finish roller 70 which is immersed in finish bath 80. Yarn 10 then passes through guide 90, wraps around high-speed puller roll 100 and associated roller 110 and is wound up as package 120. Steam-conditioner tube 50 is comprised of an upper portion surrounded by a steam jacket 52 having a steam inlet 54 and steam outlet 56 for steam maintained at a superatmospheric pressure. Steam also flows from steam jacket 52 into the inside of the conditioning tube through an orifice which is located in a replaceable plug (not shown) in the upper tube wall. The lower portion of tube 50 is heated by electrical heating element 58 which is wrapped around the tube in a helical manner. The temperature of heating element 58 is controlled by means of a conventional temperature controller 59. The steam-jacketed section of the tube is 20 inches (0.508 m) long and the electrically heated lower portion is 6 feet (1.83 m) long. Such an apparatus arrangement makes it possible to investigate the effects of steam flow and lower conditioner wall temperatures independently of one another. The pressure of the steam supply is maintained at 7.5 psig (51.7 kPa gauge) and flow of steam into the tube is controlled by replacing the orifice through the tube wall.

The yarns are wound up using a single cam windup, a helix angle of 8.5° and a windup speed of 3500 ypm (2200 mpm).

The yarns are spun under otherwise substantially conventional conditions selected to provide a yarn of 27 denier (30 dtex) containing 7 filaments.

Yarns are made with no steam and with three different steam flow rates, each at four different lower wall temperatures. The different flow rates are obtained using no steam orifice, a single orifice of 0.028 inch ($7.1\times10^{-4}$ m) diameter, a single orifice of 0.040 inch diameter, and two orifices of 0.040 inch ($1.02\times10^{-3}$ m) diameter which provide flow rates respectively of 0.00, 0.26, 0.57, and 1.14 lbs/hr (0.118, 0.259, 0.517 kg/hr) of steam. The four lower wall temperatures are 60°, 79°, 96°, and 115° C.

Figure 2:
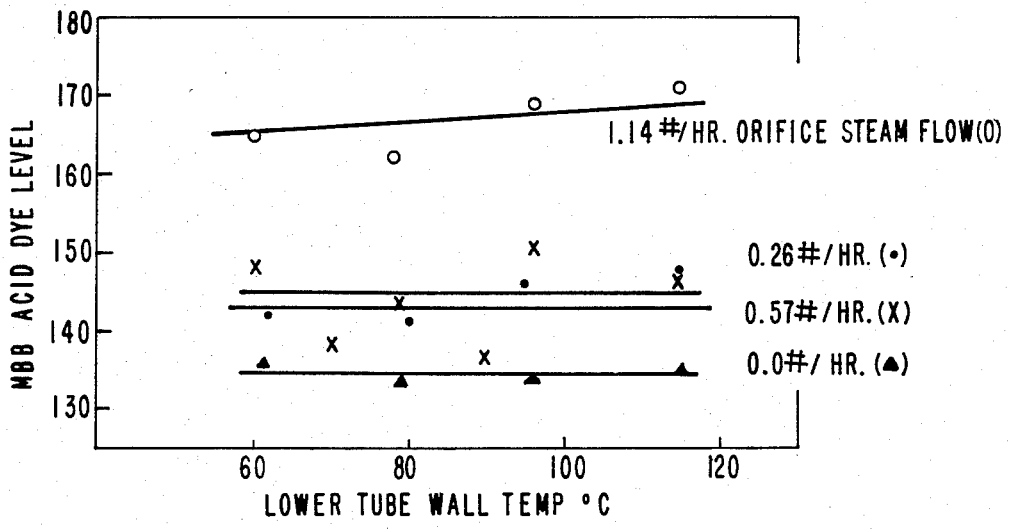
FIG. 2 is a graphical representation of spin-oriented polyamide yarn MBB acid dye level as a function both of steam flow and lower tube wall temperature in a conditioning tube prior to winding and according to FIG. 1.
Figure 3:
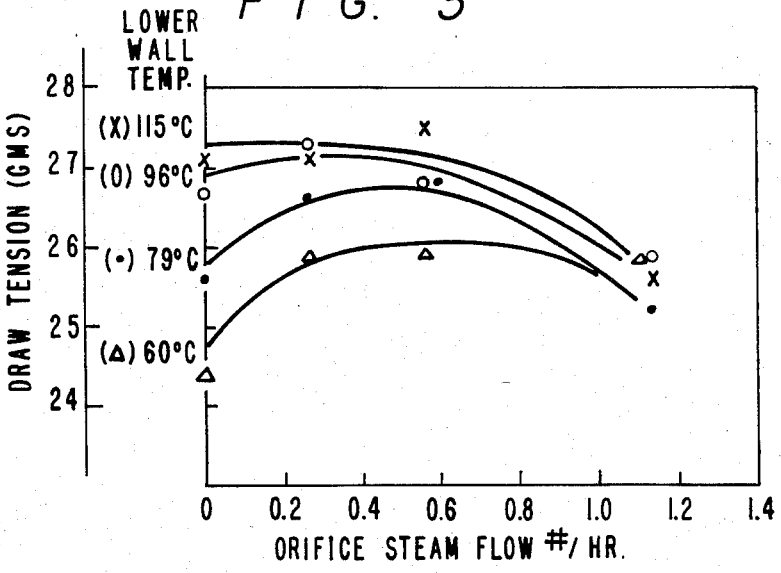
FIG. 3 is a graphical representation of draw-tension as a function of steam flow for yarns at several fixed lower wall temperatures as in FIG. 2.
Figure 4:
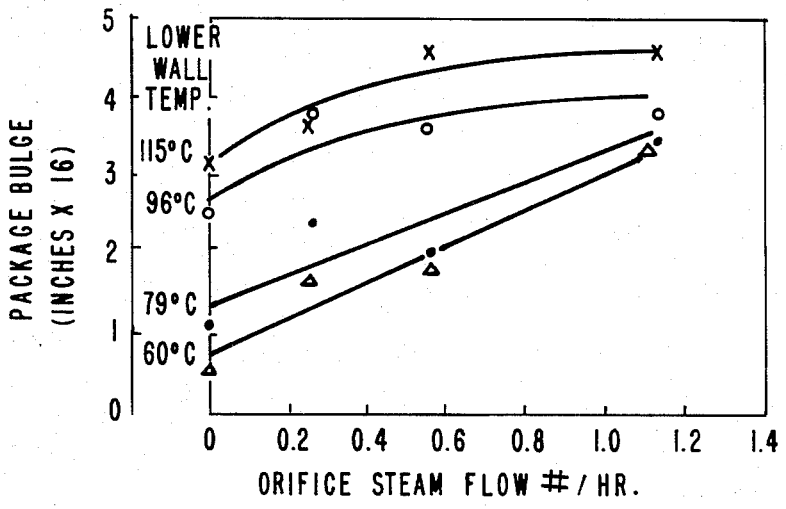
FIG. 4 is a graphical representation of yarn package bulge as a function of conditioner steam flow and lower wall temperature under the same spinning conditions as in FIGS. 2 and 3.

Yarn responses of MBB acid dye level, draw-tension, package bulge, are obtained as represented in FIGS. 2–4.

From these results it is apparent that draw-tension responds both to steam flow and lower wall temperature. Changes in lower wall temperature cause a larger response at lower steam flow rates. MBB dye level responds surprisingly substantially only to steam flow rate; i.e., changes in the lower wall temperature cause substantially no MBB dye level change. Package bulge responds to both steam flow and lower wall temperature. A 100% reduction in bulge can be obtained with less than 1 gram change in draw tension by a reduction in lower wall temperature without changing MBB dye level.

Independently controlling the lower conditioner wall temperature is a novel way to adjust package bulge and draw-tension variations without affecting MBB dye level. Process problems associated with changes in package bulge caused by draw-tension shifts during manufacture can be returned to predetermined limits by small changes in conditioner wall temperature on a machine or position basis. Electrical wall temperature control can be varied infinitely and variable more conveniently versus the conventional step changes in steam flow through changing the orifice diameter.

What is claimed is:

1. An improved high speed spinning process for making partially-oriented polyamide draw texturing feed yarns with predetermined standards including the steps of extruding molten filaments of a synthetic fiber-forming polyamide from a spinneret assembly, cooling the molten filaments to a non-tacky state in a quench chimney, conditioning the cooled filaments with steam by passage through a substantially vertical conditioning tube having heated upper and lower portions, introducing steam into the tube within its heated upper wall portion, and winding up the conditioned filaments under tension into a yarn package at a speed of from 3000 to 4000 ypm and wherein the improvement comprises regulating the temperature of the lower heated wall portion independently of the upper portion as required to maintain a yarn property that varies with changes in the lower heated wall portion, within predetermined limits while maintaining steam flow in the tube substantially constant whereby the acid dyeability of the yarn remains substantially unchanged.

2. A process of claim 1 wherein the lower heated wall temperature is regulated to maintain the yarn drawn-tension within predetermined limits.

3. A process of claim 1 wherein the lower heated wall temperature is regulated to maintain package bulging within predetermined limits.

4. Process of claim 1 wherein the polyamide is poly(-hexamethylene adipamide).

5. Process of claim 1 wherein the steam flow is set within the range of from about 0.25 to 1.25 lbs./hour and the lower pipe temperature is controlled at a temperature within the range of from about 60° to 115° C.

6. Process of claim 4 wherein the filaments are wound up at a speed of from about 3500 to about 4000 ypm into a uniform package weighing about 14 lbs. or more.

* * * * *